US009421680B1

(12) United States Patent
Bernat

(10) Patent No.: US 9,421,680 B1
(45) Date of Patent: Aug. 23, 2016

(54) MULTI-FUNCTION WORKER'S TOOL

(71) Applicant: Jeffrey Alan Bernat, Minneapolis, MN (US)

(72) Inventor: Jeffrey Alan Bernat, Minneapolis, MN (US)

( * ) Notice: Subject to any disclaimer, the term of this patent is extended or adjusted under 35 U.S.C. 154(b) by 265 days.

(21) Appl. No.: 14/293,976

(22) Filed: Jun. 2, 2014

Related U.S. Application Data

(60) Provisional application No. 61/829,749, filed on May 31, 2013.

(51) Int. Cl.
*B25F 1/02* (2006.01)

(52) U.S. Cl.
CPC ..... *B25F 1/02* (2013.01)

(58) Field of Classification Search
CPC ..... B25F 1/02
USPC ..... 30/123, 124; 451/461; 7/158
See application file for complete search history.

(56) References Cited

U.S. PATENT DOCUMENTS 2,489,005 A * 11/1949 Bourdunis ..... B24D 15/026 15/231
3,798,689 A * 3/1974 Kasemer ..... B25G 1/00 30/291
6,083,091 A * 7/2000 Anderson ..... B24D 15/026 451/355
6,951,297 B1 * 10/2005 Lopez ..... B24D 15/026 225/22

* cited by examiner

*Primary Examiner* — David B Thomas
(74) *Attorney, Agent, or Firm* — Underwood & Associates, LLC

(57) ABSTRACT

Multi-function worker's tools are disclosed that provide at least the dual functionality of a sander and a scraper/cutter. In one aspect, a multi-function worker's tool includes a body member configured to retain a length of sandpaper in a deployable configuration. The body member includes at least first and second adjoined, planar surfaces, wherein the first surface is configured for sanding in cooperation with said sandpaper, and the second surface is configured to secure said sandpaper in place. The worker's tool further includes a blade having one or more working surfaces disposed on the second surface for providing a selectable cutting or scraping working surface.

20 Claims, 6 Drawing Sheets

MULTI-FUNCTION WORKER'S TOOL

CROSS REFERENCE TO RELATED APPLICATIONS

This application claims priority to and the benefit of U.S. Provisional Patent Application No. 61/829,749, filed on May 31, 2013, the entire contents of which are incorporated by reference in their entirety as if fully set forth herein.

TECHNICAL FIELD

This disclosure relates to a multi-function worker's tool. In particular, this disclosure relates to a worker's tool that is configured to provide sanding, scraping, and cutting functionality.

BACKGROUND

Workers in the carpentry, painting, woodworking, and other trades use a variety of tools to shape, mold, and form various materials. Some of these tools are configured to remove large quantities of undesired material; for example, a planer can be used to remove layers of wood of varying thickness with each pass. On the other hand, various types of sandpaper exist to allow a worker to remove very small quantities of wood for the purpose of working a surface to a desired shape or smoothness.

Some workers enjoy the convenience of small, portable tools that help them accomplish their tasks. For example, painters use a variety of hand-held tools such as scrapers to remove old peeling paint; an electrician may carry a variety of tools in his tool belt, such as cutters, splicers, and the like. In general, it can be preferable that a tool perform multiple functions so that the number of tools a tradesman needs to carry to perform his job is minimized.

SUMMARY

In general, a multi-purpose worker's tool is provided. In one exemplary aspect, the worker's tool is configured as a hand-held assembly providing at least one surface for sanding a surface, and at least one edge configured for scraping a surface, e.g., to remove peeling paint. In this exemplary aspect, the assembly further includes a quantity of sandpaper, in rolled form, that can be pulled from within the interior of the assembly and used on an exterior portion for sanding purposes. The assembly can include other tools, such as a cutter, a nail-removing device, screwdriver heads for removing or installing screws, augers, or other tools that may be beneficial to workers in various trades.

In one exemplary aspect, a multi-function tool is disclosed. The tool includes a body member configured to retain a length of sandpaper in a deployable configuration, wherein the body member includes at least first and second adjoined surfaces. The first surface is configured for urging the sandpaper against a working surface and the second surface is configured to retain a portion of the sandpaper. The tool further includes a blade attached to the second surface for performing work on the work surface.

In one exemplary aspect, a multi-function worker's tool includes a chamber body for storing a supply of sandpaper, a first surface extending from the chamber body that is configured to receive a length of the sandpaper, and a second surface extending from the first surface having a fastening member configured to secure a blade member in a selectable orientation. The fastening member and the blade member are configured to cooperatively secure a second, different portion of the sandpaper to the second surface.

In one embodiment, the chamber is configured to store said supply of sandpaper in rolled form.

In one embodiment, the chamber is configured to store said supply of sandpaper in folded form.

In one embodiment, the multi-function worker's tool further includes a barrel portion disposed between the chamber body and the second surface that is configured for gripping by a human hand.

In one embodiment, the blade member includes one or more blade working surfaces. In a related embodiment, the blade member includes a first blade working surface configured for cutting and a second, different blade working surface configured for scraping. In a related embodiment, the multi-function worker's tool further includes a third, different blade working surface configured for scraping, wherein the second working blade surface is substantially straight, and said third blade working surface is curved.

In one embodiment, the second surface includes one or more protrusions configured to pierce the sandpaper for holding the sandpaper in place. In a related embodiment, the blade member includes a corresponding number of apertures on each blade section corresponding to each of the blade working surfaces, wherein the apertures are configured to secure the blade member in the selectable orientation.

In one embodiment, the chamber body further includes a rear wall member and a translatable abutment member configured to abut the sandpaper against an upper portion of the rear wall member to reduce the likelihood of the sandpaper shifting. In a related embodiment, the rear wall member is reversibly removable from the chamber body for accessing or replenishing the sandpaper supply.

In one embodiment, the translatable abutment member is configured and positioned on the tool such that when performing sanding operations, the heel of the user's hand is positioned over the abutment member that, in turn, applies an urging force against the sandpaper to reduce the likelihood of shifting.

In one embodiment, the chamber body includes a flexible arm member extending from a fulcrum point, wherein the abutment member is integral with the flexible arm member at a distal end. The flexible arm member is configured to flex such that an urging force can be applied to the abutment member against the sandpaper and the upper portion of the rear wall member.

In one embodiment, the first surface is planar and has a width dimension substantially equal to the width of the sandpaper.

In one embodiment, the chamber body includes an interiorly-disposed, ratcheted spindle member configured to receive a roll of said sandpaper. In a related embodiment, the spindle member is configured to reduce the likelihood of sandpaper unintentionally shifting from the chamber body.

In one embodiment, the multi-function worker's tool further includes a third, beveled surface juxtaposed between the first and the second surface that is configured as a support surface for utilizing a working surface of the blade member.

In one embodiment, the blade member is positioned above the plane of the first surface. In a related embodiment, a working surface of said blade member can engage a target surface by tilting said tool forward relative to said plane of said first surface.

In yet another exemplary aspect, a multi-function tool includes a body member configured to retain a length of sandpaper in a deployable configuration. The body member includes at least first and second adjoined, planar surfaces, where the first surface is configured for sanding, and the second surface is configured to retain a portion of the sandpaper. A blade having a plurality of working surfaces is disposed on the second surface for providing a selectable cutting or scraping working surface.

The disclosed systems and methods of using the system provide certain distinct advantages. For example, the tool can be easily used by a worker to sand wood, paint, or other materials, e.g., in preparation for further treatment such as painting. Unlike some other systems, when the usable portion of sandpaper has lost its effectiveness, the worker can pull a new section of sandpaper stored within the tool to the exterior of the tool to perform further work without needing to retrieve and install a new piece of sandpaper. One or more optional accessory tools allow a worker to use tools as needed without the need to retrieve them from a remote location, which can increase efficiency. Other advantages will be apparent to those skilled in the art.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
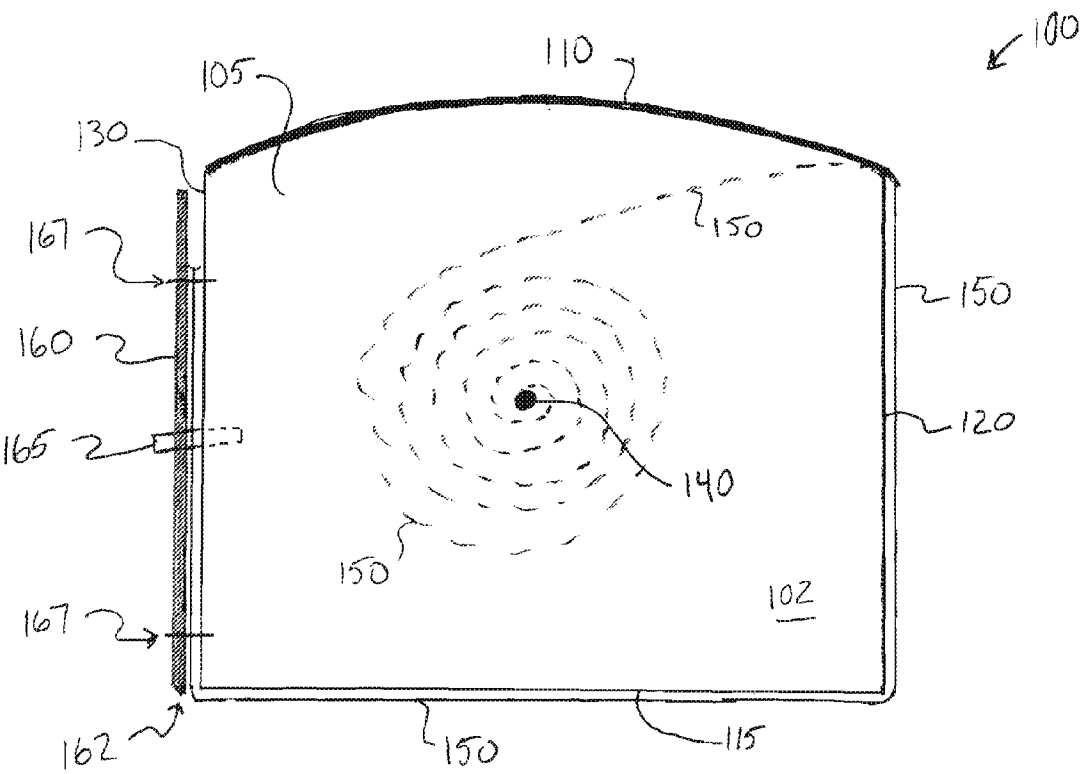
FIG. 1 is a side-view of a multi-function sanding tool according to one embodiment.
Figure 2:
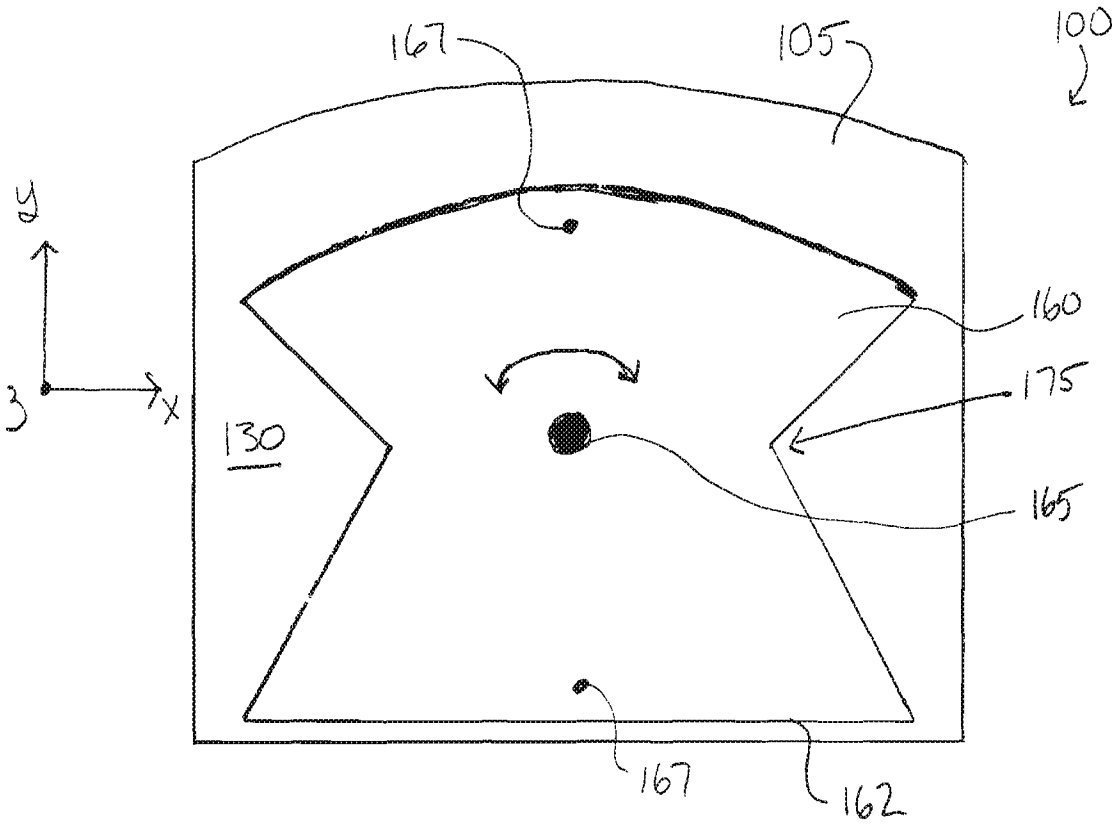
FIG. 2 is a front-view of said multi-function sanding tool according to one embodiment.

FIG. 1 is a side-view of a three-dimensional multi-function sanding tool 100 (hereinafter "tool") according to one embodiment. FIG. 2 is a front-view of said multi-function sanding tool 100, according to one embodiment. In this embodiment, the tool 100 includes a body 105 having a top curved surface 110, a rear surface 120, and a front surface 130 as illustrated; the body also includes left and right sides so as to form a substantially box-shaped body. In this embodiment, the top surface 110 is contoured to substantially fit into the palm area of a human hand and can be configured as desired for ergonomic comfort. The tool 100 is configured to be held with the hand on and about the top surface 110, allowing pressure to be exerted on the tool for sanding, scraping, cutting, and other activities such as those described herein.

In this embodiment, the tool 100 includes a hollow chamber within the tool body 105 for storing a length of sandpaper 150. The sandpaper 150 can be stored in rolled form as illustrated, or in any other configuration as desired. In this embodiment, a side of the body 105, e.g., the left side 102, can be removed or opened to expose the chamber, allowing the sandpaper to be inserted or removed as desired. In other embodiments, the chamber can be exposed by opening other sides, or a top or bottom of the body. An elongate, slot-shaped orifice (not illustrated in FIG. 1) is configured between the top surface 110 and the rear surface 120 to allow the sandpaper 150 to extend from the chamber. In this embodiment, the sandpaper can be pulled out and wrapped about the rear surface 120, bottom surface 115, and front surface 130 as illustrated. FIG. 1 shows the sandpaper 150 slightly enlarged for figure clarity, however, it will be understood that the sandpaper 150 can abut the rear (120), bottom (115) and front (130) surfaces when the tool is in an operational configuration.

In this and other embodiments, the tool 100 can be used to sand a working surface. In general, the a user can apply pressure onto the tool 100 so that a squeezing force is exerted on the sandpaper between the working surface and the bottom surface 115 of the tool, as woodworkers and other skilled artisans will appreciate. In some cases, it can be advantageous to keep the sandpaper taught, e.g., across the bottom surface 115 when a surface is being sanded. Thus, in this embodiment, the tool 100 includes a dual-purpose blade and sandpaper keeper 160 (hereinafter "blade") for securing the sandpaper 150 to a portion of the body 105.

In this embodiment, the blade 160 is configured to apply a squeezing force to the sandpaper 150 against the front surface 130 of the tool 100. While the squeezing force may be accomplished by a variety of methods, in this embodiment, the blade is urged toward the front surface 130 by one or more retaining pins 167. The retaining pins 167 can include a sharpened tip protruding from the front surface 130 as illustrated, so that the sandpaper 150 can be punctured by the retaining pins 167, thereby securing the sandpaper 150 in place. In some embodiments, the retaining pins 167 can be threaded or otherwise configured to receive a nut or other fastening mechanism for securing the sandpaper 150 in place.

In this embodiment, the blade 160 is a plate having approximately the same length and width dimensions as the front surface 130; however, other alternative dimensions can be used. The blade 160 includes a sharpened edge 162 that is configured for cutting, scraping, or other purposes. In a preferred embodiment, the sharpened edge 162 is configured for scraping a surface to prepare it to be painted.

In this embodiment, the tool 100 includes a rotatable pin 140 onto which the sandpaper 150 can be wrapped in a circular, or wound fashion, e.g., as illustrated. In one embodiment, the pin can be operably integrated with a ratchet assembly that can be opened to allow the pin to rotate when sandpaper is being withdrawn from the chamber or locked in place when pulling sandpaper taught across the bottom surface 115, respectively. It will be understood, however, that other methods can be used to store sandpaper within the chamber of the tool 100. For example, in an alternative embodiment, folded sandpaper can be stored within the chamber in a configuration that allows the sandpaper to be withdrawn from the chamber and wrapped around the tool 100 in a similar fashion to that described above. In this embodiment, a grippable handle portion can extend from the body 105, allowing a user to rotate the pin 140 when the body is in an assembled, operable configuration for sanding.

In this embodiment, the blade 160 can be rotated between a plurality of working orientations as illustrated by the double-headed arrow in FIG. 2. A pin 165 provides an axis of rotation about which the blade 160 can rotate about the x-y plane as illustrated; the blade 160 can be configured with apertures configured to receive the retaining pins 167 therethrough to fix the blade 160 in a desired orientation. In this and other embodiments, each side of the blade (e.g., each of four sides in this embodiment) can be configured with the same or different type of surface.

For example, each side of the blade can include an edge configured for scraping a working surface. Alternatively, a first side can be configured for scraping a working surface, and a second side can be configured with a razor-like edge that is configured for cutting materials such as wallpaper, sandpaper, or other materials; a third side can be configured with a wide, smooth surface for smoothing a portion of drywall or wallpaper, for example. In the embodiment shown in FIG. 2, the blade 160 includes a notched portion 175 that can be sharpened, if desired, to provide a cutting or scraping surface that can be used for cutting or scraping angled working surfaces such as wood trim and the like. In this and other embodiments, the blade 160 can include any type of edge configured as necessary to provide advantages to the worker. In this and other embodiments, the blade 160 can be removable, and other blades can be offered as accessories in a packaged product, so that a user can interchange blades of different utility depending on the type of work they are performing.

In one embodiment, the blade 160 can be positioned such that the user can tilt the tool 100 to engage the sharpened surface 162 of the blade 160 with the working surface, while at another tilt angle the tool 100 can be used for sanding without engaging the blade 160 with the working surface. Such an arrangement can minimize the likelihood of accidentally engaging the sharpened surface 162 against an unintended surface and causing undesired damage.

In general, the blade 160 can be urged against the front surface 130 to hold the sandpaper 150 in place by a variety of methods. For example, one or more springs (not illustrated in FIG. 1) can provide an urging force that pulls the blade 160 against the front surface 130. Such a method can also allow the blade to be pulled away from the front surface 130 a distance necessary to rotate the blade 160 to a desired orientation, then allow the blade 160 to return to a locked, working configuration. Other methods for urging the blade toward the front surface 130 include utilization of screws, bolts and nuts, and other fastening devices that will be apparent to those skilled in the art.

In one general aspect, the tool 100 can be used for sanding a working surface. In this disclosure, a "working surface" is the surface of a material that is intended to be modified, e.g., by sanding, scraping, cutting, smoothing, or otherwise altering the surface. To use the tool 100, a user can extract a desired amount of sandpaper from the storage compartment (chamber) by pulling the sandpaper through the aforementioned slotted orifice between the top surface 110 and the rear surface 120. The user can wrap the sandpaper around the rear (120) and bottom (115) surfaces and engage the sandpaper against the front surface 130. In doing so, the user can press the sandpaper against the protruding retainer pins with sufficient force to pierce the sandpaper to assist in holding it in place. Next, the user can engage the blade 160 against the sandpaper using, e.g., the aforementioned springs or fastening devices. To prevent additional sandpaper from escaping the chamber, the user can lock the pin 140 in place to prevent the roll of sandpaper from further movement. Any excess sandpaper drawn out that extends beyond the front surface 130 (e.g., sandpaper that exceeds the height of the front surface) can be detached by drawing the sandpaper down on a top cutting surface of the blade 160. The user can then sand the working surface by performing a sanding motion (e.g., back-and-forth) with the sandpaper engaged between the working surface and the bottom surface 115 of the tool 100. Likewise, the user can use any of the cutting, sanding, smoothing, or other edges of the blade to perform additional work.

Figure 3:
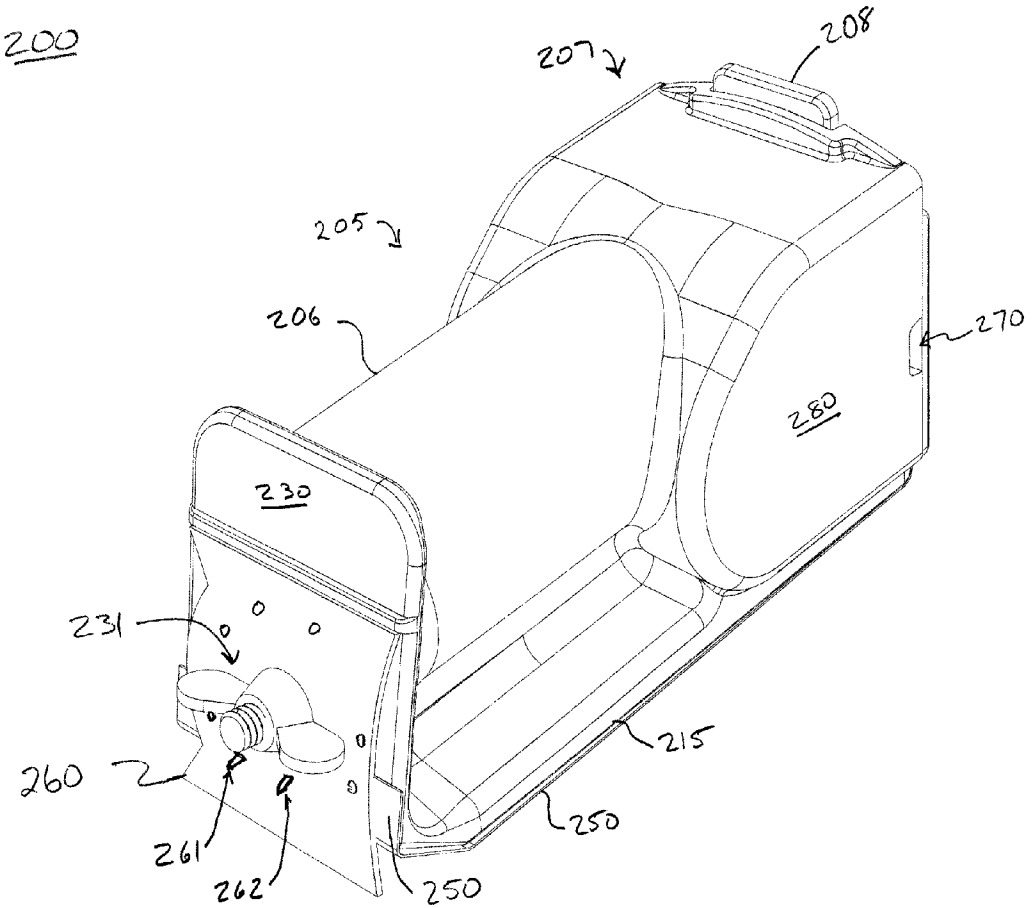
FIG. 3 is an isometric view of a worker's tool according to one embodiment.

Referring now to FIGS. 3-6, a worker's tool 200 is shown according to one embodiment. Referring first to FIG. 3, an isometric view of tool 200, in this embodiment, the tool 200 includes a main body 205 having a barrel portion 206 configured for ergonomic gripping. The main body additionally includes a chamber body 207 for storing a supply of rolled sandpaper 250 as illustrated in the cross-sectional view of FIG. 6.

In this embodiment, the tool 200 is configured to allow the sandpaper to be extended out of the chamber body 207, around a rear wall member 220, across a bottom plate 215, and at least partially around a front wall member 230.

In this embodiment, the sandpaper 250 is urged against the front wall member 230 by blade member 260; a fastener 231, in this example, a bolt/wing-nut combination, is configured to urge the blade member 260 against the front wall member 230 with sufficient securing force to secure the sandpaper 250 in place. It should be understood that the bolt/wing-nut combination can be substituted with other, alternative fastening devices capable of providing the same or similar functionality.

In this embodiment, the tool 200 includes a translatable, L-shaped abutment member 208 disposed in a top wall member 217 of the main body 205. The abutment member 208 can translate along a vertical axis and is configured to apply force to the sandpaper 250 against an upper portion 221 of the rear wall 220 to prevent sandpaper 250 from unrolling during sanding operations. In this embodiment, the main body 205 is configured to allow the barrel portion 206 to be gripped by the thumb and fingers, and the top wall member 217 and abutment member 208 are configured to receive the heel of the user's hand. Thus, when a worker performs sanding operations, the process of pressing the tool 200 against a surface can urge the abutment member 208 against upper portion 221 to substantially prevent sandpaper 250 from unrolling from the chamber body 207.

In one alternative embodiment, the top wall member can extend from the main body 205 as a flexible arm member at fulcrum 218 (FIG. 6) and be integral with abutment member 208. In general, such a flexible arm member can be configured such that an abutment surface 219 of the abutment member 208 is normally forced against the upper portion 221; however, the flexibility of the arm member can allow sandpaper to be extracted from the chamber body 207 when desired.

In this embodiment, blade member 260 is substantially equivalent to blade member 160 previously described with respect to tool 100. For example, the blade member 260 can have a plurality of blade surfaces (four, in this example) for performing cutting, scraping, and other work. The blade member 260 can be rotated into various positions to allow the worker to use a blade surface for a particular task. In this and other embodiments, the blade member 260 can include any number and type of blade surfaces desirable. For example, a first blade surface can be configured for cutting; a second blade surface can be configured for scraping a flat surface; a third blade surface can be configured for scraping a curved or coped surface; and so on.

In this embodiment, the rear wall member 220 can be configured to swing open, detach, or provide access to the interior of the chamber body 207 in other ways. In this example, the rear wall member 220 can be completely removed to access the interior of the chamber body 207. The wall member 220 can then be securely reattached and held in place through the use of one or more locking slots 280 disposed on side walls of the main body, e.g., side wall 280, in cooperation with a corresponding number of locking tabs disposed on the wall member 220.

Figure 4:
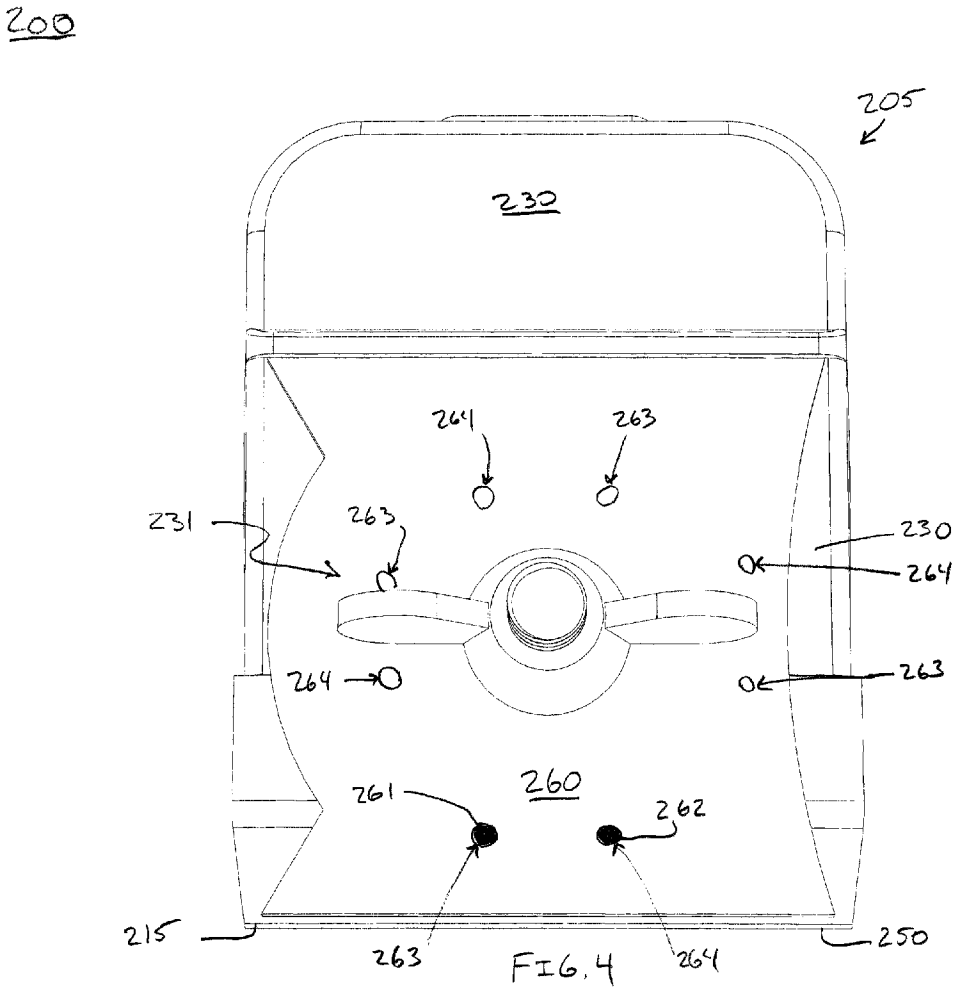
FIG. 4 is a front elevation view of the worker's tool shown in FIG. 3.
Figure 5:
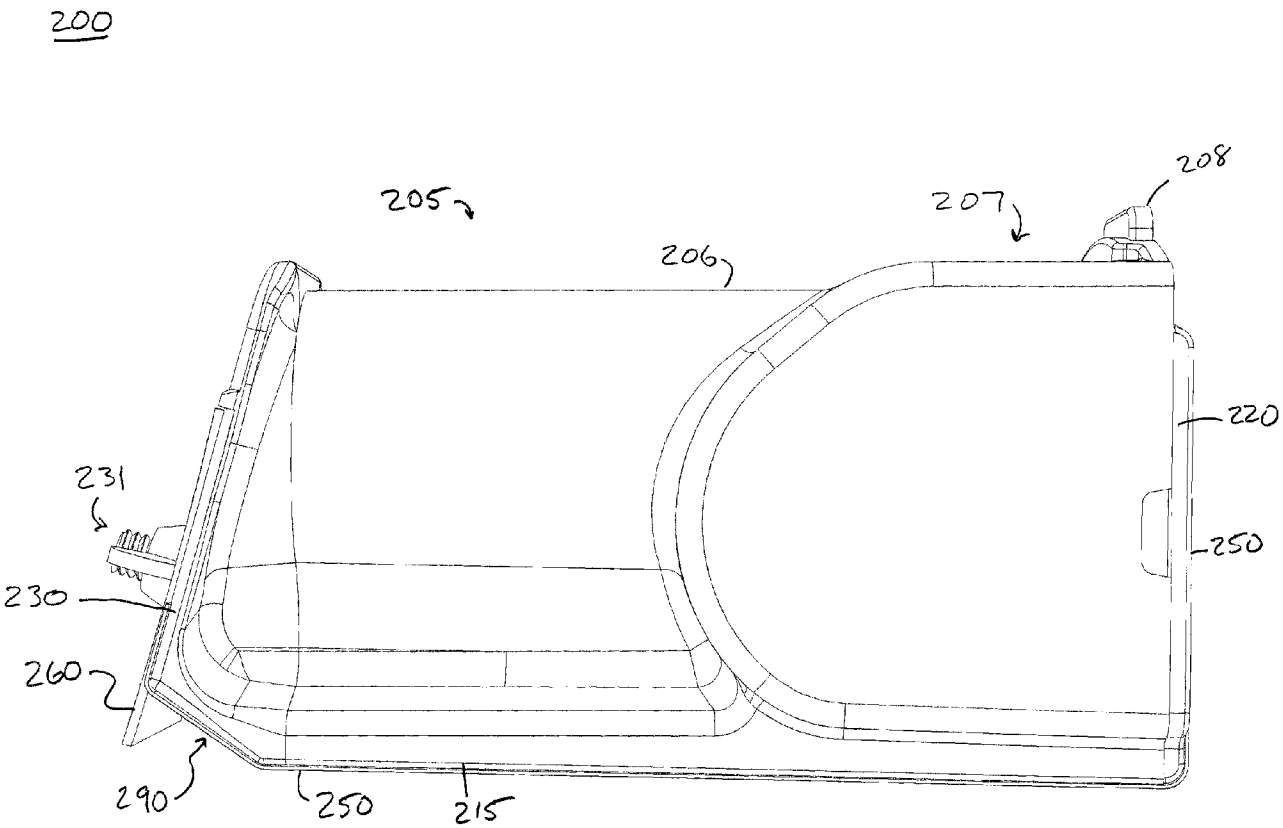
FIG. 5 is a side elevation view of the worker's tool shown in FIG. 3.
Figure 6:
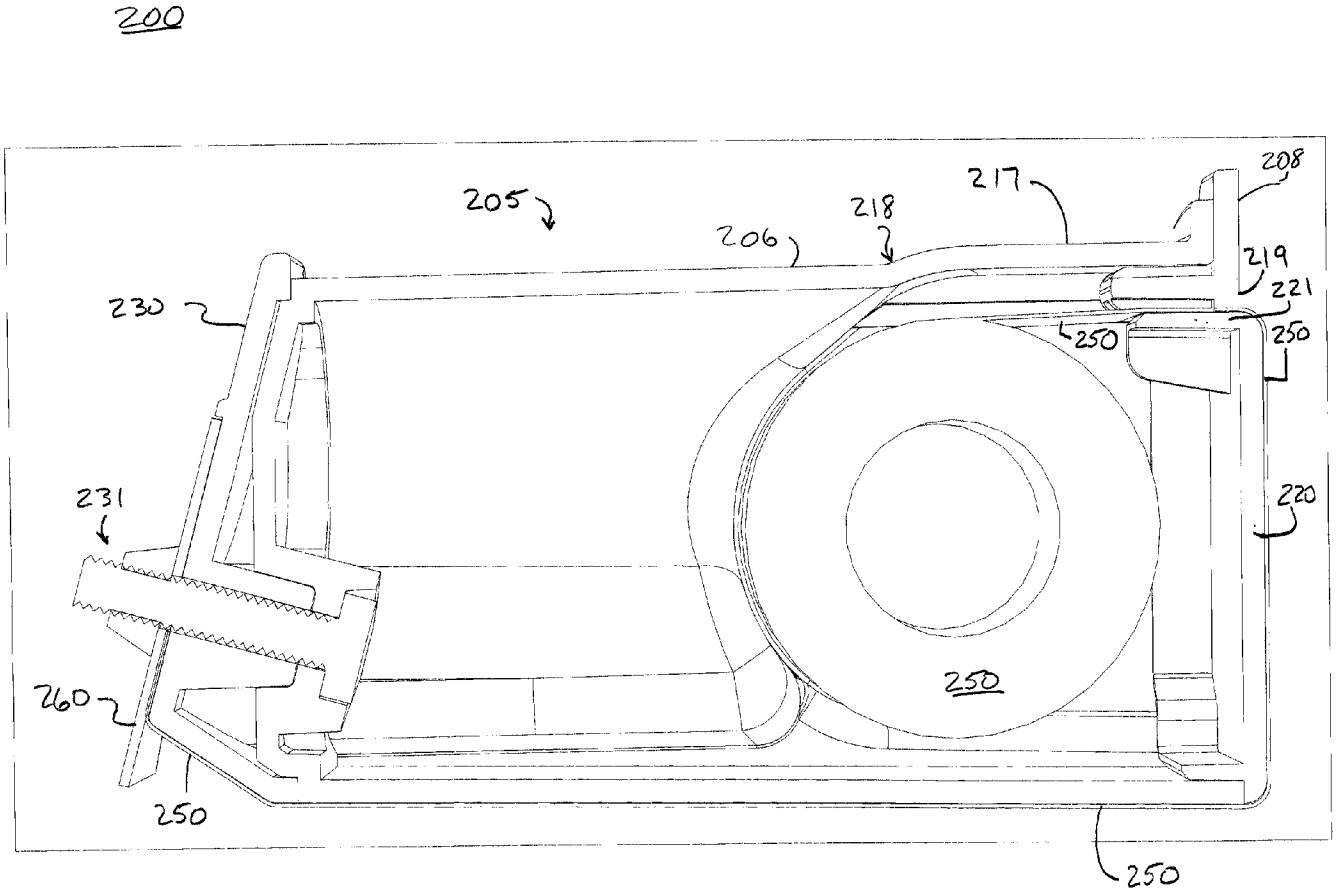
FIG. 6 is a cross-sectional elevation view of the worker's tool shown in FIG. 3.

Referring to FIGS. 3 and 4 in particular, in this embodiment, the front wall member 230 includes two protrusions 261, 262 which are disposed at a location that allows them to pierce the sandpaper 250 on a lower portion of the front wall member 230 as illustrated. The protrusions can be similar to the pointed end of a nail, for example, and can help to secure the sandpaper 250 in place cooperatively with the blade member 250. In this embodiment, each section of the blade that has a working surface, e.g., a blade or a scraper includes a number of apertures corresponding in size, shape, and position to the number of protrusions extending from the front wall member. For example, referring to FIG. 4, blade member 250 includes two apertures 263, 264 configured to receive protrusions 261, 262 as the blade is selectably oriented to use any of the four working surfaces shown which, in this example, are each ninety degrees from each other.

In general, a single worker's tool of the type described herein can provide a multi-function device for sanding, scraping, cutting, and other operations. In one example of use, a worker can draw a length of sandpaper 250 from within the chamber body 207. The sandpaper can extend around the rear wall member 220, across the bottom plate 215, and onto the front front wall member 230. The sandpaper can then be pulled taught and held in place by applying the removable blade member 260 onto the fastening device 231 and tightening. In the embodiment of FIGS. 3-6, the blade member can be tightened by turning the wing nut onto the bolt to a desired holding strength. When the sandpaper has lost its effectiveness, the worn section can be discarded and a new length can be extracted from the chamber body 207 as previously described.

In one general aspect, FIGS. 3-6 illustrate a multi-function worker's tool that includes a body 205 that includes a chamber 207 for storing a supply of sandpaper 250. The body includes a first planar sanding surface, e.g., bottom plate 215 disposed on a bottom portion of the body 205 and is configured to receive a portion of the sandpaper 250. In this non-limiting embodiment, the combination of the blade member 250 and fastening device 231 provide the capability for securing the sandpaper in place against the sanding surface (e.g., bottom plate 215) and concurrently provide a selectable working surface for cutting or scraping.

A number of illustrative embodiments have been described. Nevertheless, it will be understood that various modifications may be made without departing from the spirit and scope of the various embodiments presented herein. For example, a worker's tool, e.g., tool 100 can be sized or shaped according to preference or to address desired functionality. The body of a worker's tool, e.g., body 105 can be made of wood, metal, plastic, or any other known material that allows the tool to be used according to its intended purpose. A worker's tool, e.g., tool 100 can include written indicia, markings, grip members, or other features to enhance usability or marketability. The blade, e.g., blade 160 can be made of resilient metal, e.g., stainless steel; however, other materials can be used in alternative embodiments. The dimensions of the body, e.g., body 105, especially the bottom surface, e.g., bottom surface 115, can be such that they enhance the usability of the tool with respect to sanding operations. For example, the width of the bottom surface can substantially match the width of the sandpaper 150 so that users can sand up to abutting structures, e.g., wall joints and the like. In general, the blade member, e.g., blade member 160 or 260, can be positioned slightly above the plane of the sanding surface to reduce the likelihood of accidentally scratching a work surface when performing sanding operations. Beveled surface 290 (FIG. 5) provides a stabilizing surface that can be used when scraping to provide the capability of smoothly drawing the blade member 260 along a work surface. In such an embodiment, the tool 200 can be tilted slightly forward such that the beveled surface 290 and the blade contact the work surface; the tool can then be drawn across the work surface as desired. Accordingly, other embodiments are within the scope of the following claims.

What is claimed is:

1. A multi-function worker's tool, comprising:

a chamber body for storing a supply of sandpaper;

a first surface extending from said chamber body that is configured to receive a length of said sandpaper; and a second surface extending from said first surface having a fastening member configured to secure a blade member in a selectable orientation;

wherein said fastening member and said blade member are configured to cooperatively secure a second, different portion of said sandpaper to said second surface.

2. The multi-function worker's tool of claim 1, wherein said chamber is configured to store said supply of sandpaper in rolled form.

3. The multi-function worker's tool of claim 1, wherein said chamber is configured to store said supply of sandpaper in folded form.

4. The multi-function worker's tool of claim 1, further comprising a barrel portion disposed between said chamber body and said second surface that is configured for gripping by a human hand.

5. The multi-function worker's tool of claim 1 wherein said blade member comprises one or more blade working surfaces.

6. The multi-function worker's tool of claim 5, wherein said blade member comprises a first blade working surface configured for cutting and a second, different blade working surface configured for scraping.

7. The multi-function worker's tool of claim 6, further comprising a third, different blade working surface configured for scraping, wherein said second working blade surface is substantially straight, and said third blade working surface is curved.

8. The multi-function worker's tool of claim 1, wherein said second surface comprises one or more protrusions configured to pierce said sandpaper for holding said sandpaper in place.

9. The multi-function worker's tool of claim 8, wherein said blade member comprises a corresponding number of apertures on each blade section corresponding to each of said blade working surfaces, and wherein said apertures are configured to secure said blade member in said selectable orientation.

10. The multi-function worker's tool of claim 1, wherein said chamber body further comprises a rear wall member and a translatable abutment member configured to abut said sandpaper against an upper portion of said rear wall member to reduce the likelihood of said sandpaper shifting.

11. The multi-function worker's tool of claim 10, wherein said translatable abutment member is configured and positioned on said tool such that when performing sanding operations, the heel of the user's hand is positioned over said abutment member and applies an urging force against said sandpaper to reduce the likelihood of shifting.

12. The multi-function worker's tool of claim 10, wherein said chamber body comprises a flexible arm member extending from a fulcrum point, wherein said abutment member is integral with said flexible arm member at a distal end, and wherein said flexible arm member is configured to flex such that an urging force can be applied to the abutment member against said sandpaper and said upper portion of said rear wall member.

13. The multi-function worker's tool of claim 1, wherein said first surface is planar and has a width dimension substantially equal to the width of said sandpaper.

14. The multi-function worker's tool of claim 1, wherein said chamber body comprises an interiorly-disposed, ratcheted spindle member configured to receive a roll of sandpaper.

15. The multi-function worker's tool of claim 14, wherein said spindle member is configured to reduce the likelihood of sandpaper unintentionally shifting from said chamber body.

16. The multi-function worker's tool of claim 1, further comprising a third, beveled surface juxtaposed between said first and said second surface that is configured as a support surface for utilizing a working surface of said blade member.

17. The multi-function worker's tool of claim 1, wherein said blade member is positioned above the plane of said first surface.

18. The multi-function worker's tool of claim 17, wherein a working surface of said blade member can engage a target surface by tilting said tool forward relative to said plane of said first surface.

19. A multi-function worker's tool, comprising:

a body member configured to retain a length of sandpaper in a deployable configuration, wherein said body member comprises at least first and second adjoined, planar surfaces; wherein said first surface is configured for sanding, in cooperation with said sandpaper, and wherein said second surface is configured to secure a portion of said sandpaper in place; and a blade having a plurality of working surfaces disposed on said second surface for providing a selectable cutting or scraping working surface.

20. A multi-function worker's tool, comprising:

a body housing comprising a chamber for storing a supply of sandpaper;

a first planar sanding surface disposed on a bottom portion of said body configured to receive a portion of said sandpaper; and means for securing said sandpaper in place against said sanding surface and concurrently providing a selectable working surface for cutting or scraping.

* * * * *